US011002007B2

(12) United States Patent
Zemler et al.

(10) Patent No.: US 11,002,007 B2
(45) **Date of Patent: *May 11, 2021**

(54) PROCESS FOR ASSEMBLING A UNITIZED PANEL FOR USE WITHIN AN EXTERIOR DYNAMIC CURTAIN WALL ASSEMBLY

(71) Applicant: Hilti Aktiengesellschaft, Schaan (LI)

(72) Inventors: Matthew Zemler, Corinth, TX (US); Arndt Andresen, North Richland Hills, TX (US); Nathan Jennings, Little Elm, TX (US); Chad Stroike, Roanoke, TX (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 15/929,347

(22) Filed: Apr. 28, 2020

(65) Prior Publication Data

US 2020/0263417 A1 Aug. 20, 2020

Related U.S. Application Data

(63) Continuation of application No. 16/610,420, filed as application No. PCT/EP2018/063081 on May 18, (Continued)

(51) Int. Cl.
*E04B 1/76* (2006.01)
*E04B 1/94* (2006.01)
(Continued)

(52) U.S. Cl.
CPC ..... *E04B 1/7675* (2013.01); *E04B 1/7616* (2013.01); *E04B 1/7625* (2013.01); (Continued)

(58) Field of Classification Search
USPC ..... 52/232, 1, 573.1, 272, 317
See application file for complete search history.

(56) References Cited

U.S. PATENT DOCUMENTS 3,786,604 A * 1/1974 Kramer ..... E04B 1/6801 52/232
4,449,341 A * 5/1984 Taglianetti ..... E04B 2/88 52/235

(Continued)

FOREIGN PATENT DOCUMENTS

GB 2503465 1/2014
JP 2011-190614 9/2011

OTHER PUBLICATIONS

International Search Report dated Aug. 23, 2018 in PCT/EP2018/063081.
Written Opinion dated Aug. 23, 2018 in PCT/EP2018/063081.

*Primary Examiner* — Joshua K Ihezie
(74) *Attorney, Agent, or Firm* — Grüneberg and Myers, PLLC

(57) ABSTRACT

Described is an approved dynamic construction for effectively thermally insulating and sealing of a safing slot between a floor of a building and an exterior wall construction wherein the exterior wall construction comprises a curtain wall configuration defined by an interior wall glass surface including one or more aluminum framing members. In particular, a process for assembling a unitized panel for use within an exterior dynamic curtain wall assembly, which includes glass, especially vision glass extending to the finished floor level below, is described as well as a unitized panel assembled according to said process and its installation to improve fire stopping at the safing slot.

16 Claims, 3 Drawing Sheets

Related U.S. Application Data

2018, now Pat. No. 10,669,709, which is a continuation of application No. 15/600,295, filed on May 19, 2017, now Pat. No. 10,202,759.

(51) Int. Cl.
*E04B 2/90* (2006.01)
*E04B 1/68* (2006.01)
*E04B 1/84* (2006.01)

(52) U.S. Cl.
CPC ..... *E04B 1/948* (2013.01); *E04B 2/90* (2013.01); *E04B 1/6815* (2013.01); *E04B 1/7612* (2013.01); *E04B 1/94* (2013.01); *E04B 2001/8438* (2013.01)

(56) References Cited

U.S. PATENT DOCUMENTS 4,662,136 A * 5/1987 Tanikawa ..... E04B 2/90 52/235
4,669,240 A * 6/1987 Amormino ..... E04B 1/04 264/253
4,873,805 A * 10/1989 Ting ..... E04B 2/96 52/235
5,502,937 A * 4/1996 Wilson ..... B32B 15/14 52/273
7,424,793 B1 * 9/2008 Shriver ..... E04B 2/88 52/235
7,644,549 B2 * 1/2010 Speck ..... E04B 2/90 52/235
7,856,775 B2 * 12/2010 Stahl, Jr. ..... E04B 2/88 52/232
8,671,645 B1 * 3/2014 Shriver ..... E04B 2/88 52/741.4
8,683,763 B2 * 4/2014 Shriver ..... E04B 1/947 52/235
9,016,014 B2 * 4/2015 Shriver ..... E04B 2/96 52/235
10,669,709 B2 * 6/2020 Zemler ..... E04B 1/7616
2007/0204540 A1 * 9/2007 Stahl, Sr. ..... E04B 5/00 52/274
2009/0126297 A1 * 5/2009 Stahl, Jr. ..... E04B 2/88 52/235
2010/0107532 A1 * 5/2010 Shriver ..... E04B 2/96 52/317
2013/0061544 A1 * 3/2013 Stahl, Jr. ..... A62C 2/10 52/232
2013/0097948 A1 * 4/2013 Burgess ..... E04B 2/00 52/232
2013/0269272 A1 * 10/2013 Turner ..... E04C 2/40 52/309.6
2015/0240488 A1 * 8/2015 Evensen ..... E06B 7/14 52/235
2015/0284950 A1 * 10/2015 Stramandinoli ..... E04B 2/90 52/235
2016/0356034 A1 * 12/2016 Andresen ..... E04B 2/90
2017/0145685 A1 * 5/2017 Andresen ..... E04B 2/96
2018/0163397 A1 * 6/2018 Long ..... E04B 1/941
2019/0284798 A1 * 9/2019 Klein ..... E04B 1/94
2020/0332525 A1 * 10/2020 Klein ..... E04B 2/96

* cited by examiner

PROCESS FOR ASSEMBLING A UNITIZED PANEL FOR USE WITHIN AN EXTERIOR DYNAMIC CURTAIN WALL ASSEMBLY

CROSS-REFERENCE TO RELATED APPLICATIONS

This application is a Continuation of U.S. patent application Ser. No. 16/610,420, filed Nov. 1, 2019 and incorporated herein by reference, which is a National Stage entry under § 371 of international Application No. PCT/EP2018/063081, filed on May 18, 2018 and incorporated herein by reference, and which claims priority to U.S. patent application Ser. No. 15/600,295, filed on May 19, 2017 and incorporated herein by reference.

FIELD OF THE INVENTION

The present invention relates to the field of constructions, assemblies and systems designed to thermally and acoustically insulate and seal a safing slot area defined between a curtain wall and the individual floors of a building. In particular, the present invention relates to a process for assembling a unitized panel for use within an exterior dynamic curtain wall assembly, which includes glass, especially vision glass extending to the finished floor level below. Further, the present invention relates to a unitized panel assembled according to said process and its installation to improve fire stopping at the safing slot.

BACKGROUND OF THE INVENTION

Curtain walls are generally used and applied in modern building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

Due to the recent developments on the building construction market, unitized panels play an important role when a curtain wall is built-up. The use of unitized panels make installation of a curtain wall easier to the installer, as the pre-assembled curtain wall panel will be quickly installed on the jobsite. Unitized panels are built offsite in a curtain wall manufacturing facility. These unitized panels are then assembled in a controlled manufacturing process and shipped to the construction jobsite where they will be hung on the building. This process is highly desirable since it allows for quick and clean installation of the unitized panel on the jobsite when compared, for example, to the used stick build façade construction. Further, this pre-manufacturing of unitized panels ensures the quality of fire protection that is required according to various standards.

In general, a glass curtain wall structure or glass curtain wall construction is defined by an interior wall glass surface including one or more framing members and at least one floor spatially disposed from the interior wall surface. The gap between the floor and the interior wall surface of a curtain wall defines a safing slot, also referred to as perimeter slab edge (void), extending between the interior wall surface of the curtain wall construction and the outer edge of the floor. This safing slot is essential to slow the passage of fire and combustion gases between floors. Therefore, it is of great importance to improve fire stopping at the safing slot in order to keep heat, smoke and flames from spreading from one floor to an adjacent floor. It is important to note that the firestop at the perimeter slab edge is considered a continuation of the fire-resistance-rating of the floor slab. In general, the standard fire test method NFPA 285 provides a standardized fire test procedure for evaluating the suitability of exterior, non-load bearing wall assemblies and panels used as components of curtain wall assemblies, and that are constructed using combustible materials or that incorporate combustible components for installation on buildings where the exterior walls have to pass the NFPA 285 test.

In order to obtain certified materials, systems and assemblies used for structural fire-resistance and separation of adjacent spaces to safeguard against the spread of fire and smoke within a building and the spread of fire to or from the building, the International Building Code IBC 2012 provides minimum requirements to safeguard the public health, safety and general welfare of the occupants of new and existing buildings and structures. According to the International Building Code IBC 2012 Section 715.4, voids created at the intersection of the exterior curtain wall assemblies and such floor assemblies shall be sealed with an approved system to prevent the interior spread of fire where fire-resistance-rated floor or floor/ceiling assemblies are required. Such systems shall be securely installed and tested in accordance with ASTM E 2307 to provide an F-rating for a time period at least equal to the fire-resistance-rating of the floor assembly.

However, there is a code exception that states that voids created at the intersection of the exterior curtain wall assemblies and such floor assemblies, where the vision glass extends to the finished floor level, shall be permitted to be sealed with an approved material to prevent interior spread of fire. Such material shall be securely installed and capable of preventing the passage of flame and hot gasses sufficient to ignite cotton waste when subjected to ASTM E 119 time-temperature fire conditions under a minimum positive pressure differential of 0.01 inch of water column for the time period at least equal to the fire-resistance-rating of the floor assembly.

Although some glass and frame technologies have been developed that are capable of passing applicable fire test and building code requirements, there is hardly any system that addresses the exception stated in the International Building Code IBC 2012 Section 715.4 and fulfills the code section ASTM E 2307 full-scale testing.

However, there is no system known of which parts can be pre-assembled that addresses above mentioned exception and at the same time complies with the requirements according to ASTM Designation: E 1399-97 (Reapproved 2005), in particular having a movement classification of class IV, when finally installed. Class IV is a combination of thermal, wind, sway and seismic movement types. These have been tested according to the invention in both horizontal and vertical conditions. The E 1399, Standard Test Method for Cyclic Movement and Measuring the Minimum and Maximum Joint Widths of Architectural Joint Systems, is used for simulation of movements of the ground, such as for example an earthquake, or even movements under high wind load or life load. In particular, there is no system known that is used in a curtain wall structure that provides a dynamic system complying with ASTM E 1399, such as for example a curtain wall structure defined by an interior wall surface, which includes an interior panel, such as a back pan, extending over the interior surface thereof and at least one floor spatially disposed from the inner wall surface, thereby sealing of the safing slot between the floor and the back pan of this curtain wall, which extends between the interior wall surface of the interior panel and the outer edge of the floor, in particular when vision glass is employed. Said safing slot is needed to compensate dimensional tolerances of the concreted floor and to allow movement between the floor and the façade element caused by load, such by life, seismic or wind load.

Due to the increasingly strict requirements regarding fire-resistance as well as horizontal and vertical movement, there is a need for a dynamic, thermally and acoustically insulating and sealing system for a curtain wall structure that is capable of meeting or exceeding existing fire test and building code requirements and standards including existing exceptions and which can be easily installed on the jobsite. In particular, there is a need for a pre-manufactured unitized panel, ready to be installed on the jobsite, that prevents in its final installation the spread of fire when vision glass of a curtain wall structure extends to the finished floor level below even when exposed to certain movements (complying with the requirements for a class IV movement).

In view of the above, it is an object of the present invention to provide a process for assembling a unitized panel for use within an exterior dynamic curtain wall assembly, which includes glass, especially vision glass extending to the finished floor level below.

Further, it is an object of the present invention to provide a unitized panel that is full-scale ASTM E 2307 as well as ASTM E 1399 tested, to address the code exception, to avoid letters and engineering judgments, and to secure and provide defined/tested architectural detail for this application, in particular, by providing a tested panel for fire—as well as movement-safe architectural compartmentation and which makes it easier for the installers to build up the curtain wall on the jobsite.

Still further, it is an object of the present invention to provide a process for installing the unitized panel of the invention to improve fire stopping at the safing slot of an exterior dynamic curtain wall assembly.

Still further, it is an object of the present invention to provide at the same time a unitized panel, which is used as an acoustic insulating and sealing system for effectively acoustically insulating and sealing of the safing slot between a curtain wall structure and the edge of a floor.

These and other objectives as they will become apparent from the ensuing description of the invention are solved by the present invention as described in various embodiments. Preferred embodiments further describe the invention.

SUMMARY OF THE INVENTION

In one aspect, the present invention provides a process for assembling a unitized panel for use within an exterior dynamic curtain wall assembly. In particular, it is an aspect of the present invention to provide such a process comprising the following steps:

- assembling the frame for the unitized panel by fastening the left and right vertical framing members and upper and lower horizontal framing members together;
- installing the anchor brackets to the upper locations of the vertical framing members ready for mounting the finished unitized panel to the building structure;
- installing the appropriate water gasket seals to the framing members to seal the unitized panel and building structure from water intrusion;
- installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member, thereby forming a substantially U-shaped cavity;
- installing supporting and attachment elements to fasten the substantially U-shaped cavity to an inner facing side of the vertical framing member, thereby forming a 5-sided box pan;
- installing additional gaskets, hardware, and components necessary to prepare the unitized panel for glass installation;
- completion of the unitized panel by installing glass and appropriate sealing layers to the unitized panel; and
- optionally installing a thermally resistant material into the substantially U-shaped cavity.

In another aspect, the present invention provides a process for installing the unitized panel to improve fire stopping at the safing slot of an exterior dynamic curtain wall assembly.

In yet another aspect, the present invention provides a unitized panel assembled according to said process.

In yet another aspect, the present invention provides a unitized panel which is used as an acoustic insulating and sealing system within an exterior dynamic curtain wall assembly.

BRIEF DESCRIPTION OF THE FIGURES

The subject matter of the present invention is further described in more detail by reference to the following figures.

DETAILED DESCRIPTION OF THE INVENTION

Figure 1:
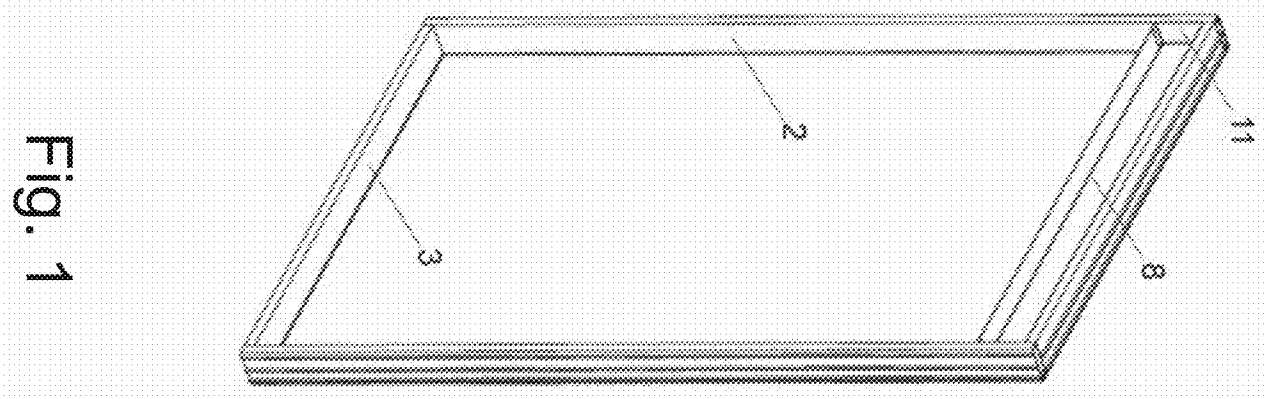
FIG. 1 shows a perspective view of a unitized panel for use within an exterior dynamic curtain wall assembly.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" or "curtain wall assembly" in context with the present invention refers to a wall structure defined by an interior wall surface including one or more framing members and at least one floor spatially disposed from the interior wall surface of the curtain wall construction. In particular, this refers to a glass curtain wall construction or glass curtain wall structure defined by an interior wall glass surface including one or more extruded framing members, preferably made of aluminum, and at least one floor spatially disposed from the interior wall glass surface.

The term "safing slot" in context with the present invention refers to the gap between a floor and the interior wall surface of the curtain wall construction as defined above; it is also referred to as "perimeter slab edge", extending between the interior wall surface of the curtain wall construction, i.e., vision glass and framing member, and the outer edge of the floor.

The term "zero spandrel" in context with the present invention refers to a horizontal framing member, also called transom, which is located at floor level, i.e., bottom of the transom at the level as top of the floor, preferably concrete floor.

The term "interior wall surface" in context with the present invention refers to the inner facing surface of the curtain wall construction as defined above, in particular, to the inner facing surface of the infilled vision glass and the inner facing surface of the framing members.

The term "cavity-shaped profile" in context with the present invention refers to any shaped profile that is capable of receiving a thermally resistant material for insulating. In particular, the cavity-shaped profile refers to a U-shaped profile, a trapezoidal-shaped profile, a triangular-shaped profile, rectangular-shaped profile, octagonal-shaped profile, preferably to a U-shaped cavity. These profiles can be formed from one or more components.

The unitized panel and its process for assembling according to the present invention is comprised of different elements which provide in accordance with each other for a system that addresses the code exception and meets the requirements of standard method ASTM E 2307 and complies with the requirements of standard method ASTM E 1399, and is described in the following:

According to the present invention, the process for assembling a unitized panel for use within an exterior dynamic curtain wall, comprises the following steps:

- assembling the frame for the unitized panel by fastening the left and right vertical framing members and upper and lower horizontal framing members together;
- installing the anchor brackets to the upper locations of the vertical framing members ready for mounting the finished unitized panel to the building structure;
- installing the appropriate water gasket seals to the framing members to seal the unitized panel and building structure from water intrusion;
- installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member, thereby forming a substantially U-shaped cavity;
- installing supporting and attachment elements to fasten the substantially U-shaped cavity to an inner facing side of the vertical framing member, thereby forming a 5-sided box pan;
- installing additional gaskets, hardware, and components necessary to prepare the unitized panel for glass installation;
- completion of the unitized panel by installing glass and appropriate sealing layers to the unitized panel; and
- optionally installing a thermally resistant material into the substantially U-shaped cavity.

In particular, in a first step the frame for the unitized panel is assembled by fastening the left and right vertical framing members and upper and lower horizontal framing members together using conventional fastening and assembling means for building the frame of unitized panels. Usually, rectangular aluminum tubing mullions and transoms are sized according to the curtain wall system manufacturer's guidelines that will manufacture the unitized panels.

In a second step, the anchor brackets are installed to upper locations of the vertical framing member ready for mounting the finished unitized panel to the building structure, followed by a third step wherein the appropriate water gasket seals are installed to the framing members to seal the unitized panel and building structure from water intrusion.

In a fourth step, the substantially U-shaped cavity is created by installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member. The connection of the two L-shaped members van be made via one or more screws, pins, bolts, anchors and the like. The back of the U-shaped cavity is positioned spatially disposed from the interior wall surface of the curtain wall construction, preferably spatially disposed from the inner surface of the vision glass infill.

This U-shaped cavity is considered for the purpose of facilitating fire stopping by receiving and encasing a thermally resistant material positioned in a safing slot present in those buildings utilizing pre-manufactured unitized panels, in particular glass panels in glass curtain wall structures, wherein the vision glass extends to the finished floor level, i.e., in the zero spandrel area of a glass curtain wall construction including only vision glass.

It is preferred that the L-shaped members are comprised of non-combustible material, preferably a metal material, most preferably steel, galvanized or plain. In a most preferred embodiment, the L-shaped members are made of a 12 or 18 gauge galvanized steel material or aluminum, such as an extruded aluminum. However, it is also possible that L-shaped members are comprised of a composite material or a material which is fiber-reinforced.

In one embodiment, the first leg of the first L-shaped member has a length of about 3 inch and a second leg of the first L-shaped member has a length of about 6 inch, and a first leg of the second L-shaped member has a length of about 1 inch and a second leg of the second L-shaped member has a length of about 3 inch. In an alternative embodiment, the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch.

However, it is also possible to form the cavity-shaped profile using one or more pieces which are bent or somehow fastened together to form the various profiles, such as a trapezoidal-shaped profile, a triangular-shaped profile, rectangular-shaped profile, or octagonal-shaped profile for receiving a thermally resistant material for insulating. The U-shaped cavity can be designed using various number of pieces. It can be constructed using a single piece but the cost will increase due to the complexity and number of required bends.

Preferably, the U-shaped cavity is formed from two L-shaped members, wherein the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch, making it easy for the manufacturer to assemble the unitized panel. In particular, the curtain wall manufacturer does not need to flip the curtain wall to gain access to the zero spandrel attachments.

Fastening of the two L-shaped members may be performed by fastening means selected from the group consisting of pins, expansion anchors, screws, screw anchors, bolts and adhesion anchors. Preferably fastening is performed by No. 10 self-drilling sheet metal screws. It is preferred that the fastening of the first L-shaped member takes place through the first leg and is fastened to the bottom of the horizontal framing member of the curtain wall construction. However, any other suitable fastening region may be chosen as long as maintenance of complete sealing of the safing slot is guaranteed.

In a next step, elements for supporting and attaching are installed to fasten the substantially U-shaped cavity to an inner facing side of the vertical framing member. Preferably, these elements have a substantially L-shaped profile and are positioned so that the gap between U-shaped cavity and the vertical framing member is closed due to the architectural structure of the glass curtain wall assembly, thereby forming a 5-sided box pan.

It is preferred that elements for supporting and attaching are comprised of a non-combustible material, preferably a metal material, most preferably steel. In a particular preferred embodiment of the present invention, these elements are angle brackets made from a 12 or 18 gauge galvanized steel material or aluminum, such as an extruded aluminum. In a most preferred embodiment, a first leg of the angle bracket has a length of about 3 inch and a second leg of the angle bracket has a length of about 1 inch. Dimensions and geometric design of these elements may be varied and adapted to address joint width and mullion location in a degree known to a person skilled in the art.

Dimensions, material and geometric design of the complete U-shaped cavity, also referred to as 5-sided box pan or zero spandrel box, may be varied and adapted to address joint width and transom location in a degree known to a person skilled in the art.

In a sixth step, additional gaskets, hardware, and components necessary to prepare the unitized panel for glass installation are installed according to the curtain wall manufacture's guidelines; followed in a seventh step by completion of the unitized panel by installing glass and appropriate sealing layers to the unitized panel.

The so assembled unitized panel may be complemented with a thermally resistant material installed into the substantially U-shaped cavity. In particular, the thermally resistant material that can be installed into the substantially U-shaped cavity is a thermally resistant flexible material such as a mineral wool material, most preferably is a mineral wool bat insulation having a 3 inch thickness, 8-pcf density, installed with no compression. However, in order to use this panel within an exterior dynamic curtain wall assembly it is not essential to install the curtain wall before transporting the assembled panel to the jobsite.

Once the unitized panel is assembled according to the above-described process, it ready for installation to improve fire stopping at the safing slot of an exterior dynamic curtain wall assembly. In particular, this process comprises the following steps:

hanging the unitized panel to the building structure;

installing a thermally resistant material in the safing slot; and applying an outer fire retardant coating positioned across the thermally resistant material installed in the safing slot and the adjacent portions of the vertical and horizontal framing members and the floor located thereadjacent.

Once the unitized panel is delivered to the jobsite, the panel is simply hung on the building and a thermally resistant material is installed in the safing slot. Preferably, the thermally resistant material is a thermally resistant flexible mineral wool and installed with fibers running parallel to the outer edge of the floor and the curtain wall. Moreover, it is preferred that a min. 4 inch thick, 4-pcf density, mineral wool bat insulation is employed, if the U-shaped cavity of the unitized panel is already filled with an insulating material and most preferably installed with 25% compression in the nominal joint width. The mineral wool bat is to be installed flush with the top surface of the concrete floor.

Splices, also referred to as butt joints in the lengths of the mineral batt insulation are to be tightly compressed together.

In case the U-shaped cavity of the unitized panel has not been filled with a thermally resistant material before delivering it to the jobsite, insulation of the safing slot is ensured by filling the cavity to a depth of 2⅞ inch with 4-pcf density mineral wool batt insulation with the fibers running parallel to the floor and compressing the packing material 25% vertically in the U-shaped cavity. This step is followed by installation of a thermally resistant material as above installed in the safing slot.

In order to finalize complete fire protection of the safing slot, in particular in front of the vertical framing members, a further thermally resistant material for insulating may be positioned in the safing slot in abutment with respect to the vertical framing member, i.e. located in front of the vertical framing member.

It is preferred that the thermally resistant material for insulating is a thermally resistant flexible material such as a mineral wool material, to facilitate placement thereof into the safing slot and in front of the vertical framing member.

This thermally resistant flexible material can be integrally connected to the thermally resistant flexible material installed in the safing slot, and preferably made of a thermally resistant flexible mineral wool material installed with fibers running parallel to the outer edge of the floor. Moreover, it is preferred that a 12 inch long, 4-pcf density, mineral wool bat insulation is centered at the vertical framing member, i.e., mullion, and installed with 25% compression and depth to overcome the slab thickness. This installation is also referred to as the integrated mullion cover.

In a particular preferred embodiment, the insulation material in the safing slot is installed continuously and in abutment with respect to the outer edge of the floor, the filled U-shaped cavity, and the interior facing surface of the vertical framing member.

It is preferred that the upper as well as the lower primary surfaces of the filled U-shaped cavity and the insulation material in the safing slot are flush with respect to the upper and lower side of the floor, and the sides of the U-shaped cavity, respectively.

When installing, the insulating elements are compressed to varying degrees, but normally compressed to approximately 25% in comparison to a standard of 33%. This compression will cause exertion of a force outwardly against the other elements of the system in order to expand outwardly to fill voids created in the safing slot.

To improve fire stopping at the safing slot of an exterior dynamic curtain wall assembly, an outer fire retardant coating is applied and positioned across the thermally resistant material installed in the safing slot and the adjacent portions of the vertical and horizontal framing members and the floor located there adjacent. The sealing characteristics of the installed unitized panel within an exterior dynamic curtain wall assembly shown in the present invention are significantly enhanced by the application of such fire retardant coating.

Generally, such fire retardant coatings are applied by spraying or other similar means of application. Such fire retardant coatings, in particular outer fire retardant coatings, are for example firestop joint sprays, preferably based on water, and self-leveling silicone sealants. For example, Hilti Firestop Joint Spray CFS-SP WB can be used as an outer fire retardant coating in accordance with the present invention. In one preferred embodiment of the present invention the outer fire retardant coating is an elastomeric outer fire retardant coating, water-based or silicone-based outer fire retardant coating, preferably a firestop joint spray. The outer fire retardant coating that can be applied in the installed system of the present invention is preferably in the form of an emulsion, spray, coating, foam, paint or mastic.

According to one embodiment of the present invention, it is preferred that the outer fire retardant coating has a wet film thickness of at least ⅛ inch or 2 mm. Additionally, it is preferable that the outer fire retardant coating covers the top of the thermally resistant flexible mineral wool material overlapping the outer edge of the floor and the interior face of the vertical and the horizontal framing member surface of the curtain wall assembly by a min. of ½ inch. The outer fire retardant material can be applied across the insulation installed in the safing slot and the adjacent areas of the interior wall surface and floor.

According to the present invention, the process for assembling a unitized panel may further comprise the application of a silicone sealant, preferably a firestop silicon, in order to restrict air movement and to serve as a vapor barrier. The application of a silicone sealant allows the usage of an unfaced curtain wall insulating material, i.e., mineral wool without any foil or tape around the outside, in particular in cases, where the cavity-shaped profile consists of more the one pieces.

The unitized panel of the present invention is also for acoustically insulating and sealing of a safing slot of a curtain wall structure. The material used for insulating may be of a sound resistant and/or air tight material, such as a mineral wool material coated with an acrylic- or silicone-based material, rubber-like material or a foam, such for example an elastomeric interlaced foam based on synthetic rubber (Armaflex), a polyethylene foam, a polyurethane foam, a polypropylene foam or a polyvinyl chloride foam.

While the invention is particularly pointed out and distinctly described herein, a preferred embodiment is set forth in the following detailed description which may be best understood when read in connection with the accompanying drawings.

In FIG. 1 a perspective view of an assembled unitized panel for use within an exterior dynamic curtain wall assembly is depicted. The U-shaped cavity 8 and supporting and attachment elements 11 are installed to the vertical framing member 2 and to the horizontal framing member 3 within the zero-spandrel area of a curtain wall structure forming a 5-sided box pan 8 or also referred to as a zero spandrel box.

Figure 2:
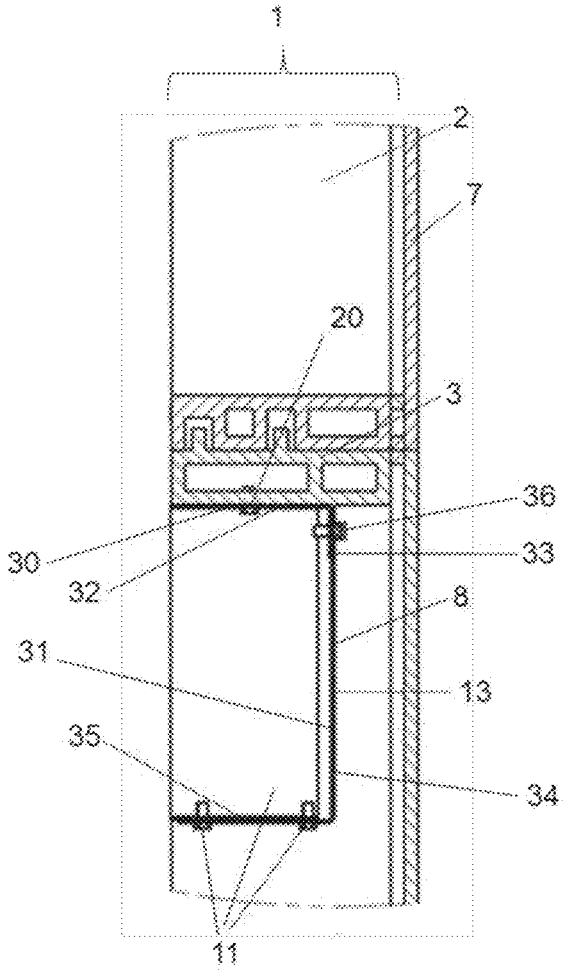
FIG. 2 shows a side cross-sectional detailed view of a unitized panel construction at a horizontal framing member (transom).

FIG. 2 shows side cross-sectional detailed view of a unitized panel construction at a horizontal framing member (transom). The detailed transom structures clearly depicts the U-shaped cavity within a unitized panel construction. The unitized glass curtain wall panel is defined by an interior wall surface 1 including one or more framing members, i.e., vertical framing member—mullion 2—and horizontal framing member—transom 3—which is located at the floor level when installed. The framing members 2 and 3 are infilled with vision glass 7 extending to the finished floor level below. The assembled unitized panel comprises a first L-shaped member 30 and a second L-shaped member 31 connected to each other to form the U-shaped cavity 8, made of a non-combustible material, such as metal, preferably made from an 18 gauge galvanized steel material, for receiving a thermally resistant material for insulating 9 (shown as dashed lines in FIG. 3). Supporting and attachment elements 11 (partially shown in FIG. 2) fasten the substantially U-shaped cavity 8 to an inner facing side 12 of the vertical framing member 2. Elements 20 for fastening the U-shaped cavity to the upper horizontal framing member 3 and upper locations of the vertical framing member 2 are preferably No. 10 self-drilling sheet metal screws. The back 13 of the U-shaped cavity is positioned spatially disposed from the interior wall surface of the curtain wall construction, preferably spatially disposed from the inner surface of the vision glass infill 7. In particular, FIG. 2 shows that the first L-shaped member 30 has a first leg 32 and a second leg 33 perpendicular to each other, and the second L-shaped 31 member has a first leg 34 and a second leg 35 perpendicular to each other, wherein the first leg 34 of the second L-shaped member 31 is connected to the second leg 33 of the first L-shaped member 30, thereby forming a substantially U-shaped profile 8. The connection of the two L-shaped members 30, 31 occurs via a No. 10 self-drilling sheet metal screw 36. The L-shaped members 30, 31 are comprised of a non-combustible material, such as metal, preferably made from an 18 gauge galvanized steel material.

Figure 3:
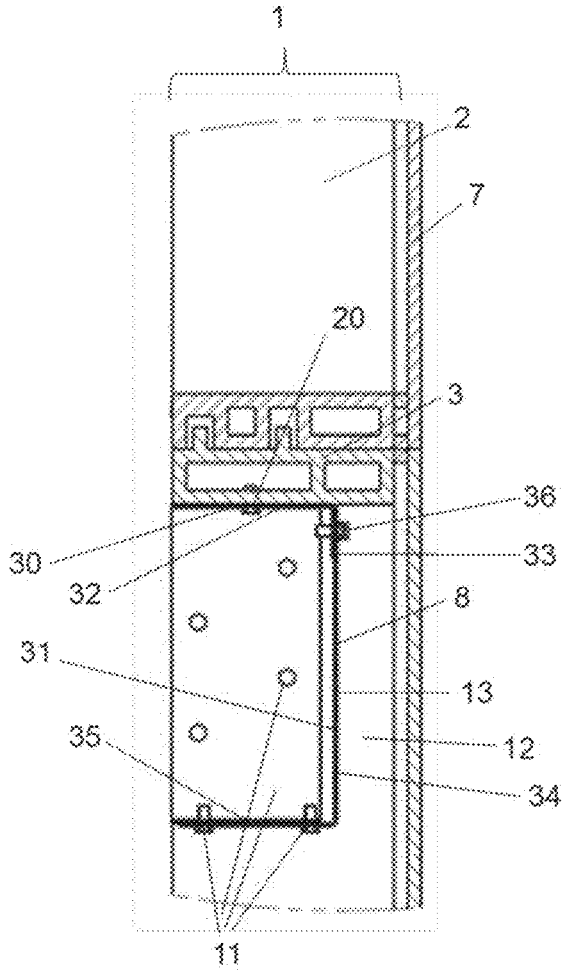
FIG. 3 shows a side cross-sectional detailed view of a unitized panel construction at vertical framing member (mullion).

FIG. 3 shows a side cross-sectional detailed view of a unitized panel construction at a horizontal framing member (transom). FIG. 3 shows supporting and attachment elements 11 (partially also shown in FIG. 2) for fastening the substantially U-shaped cavity 8 to an inner facing side 12 of the vertical framing member 2. The supporting and attachment elements 11 have a substantially L-shaped profile and are positioned so that the gap between U-shaped cavity 8 and the vertical framing member 2 is closed due to the architectural structure of the glass curtain wall assembly and is comprised of a non-combustible material, preferably a metal material, most preferably steel. As shown in FIG. 3, the supporting and attachment element 11 is an angle bracket made from 18 gauge galvanized steel material, preferably a first leg of the angle bracket has a length of about 3 inch and a second leg of the angle bracket has a length of about 1 inch. The elements for attachment are No. 10 self-drilling sheet metal screws. The other remaining elements of the unitized panel are the same as described for FIG. 2.

Figure 4:
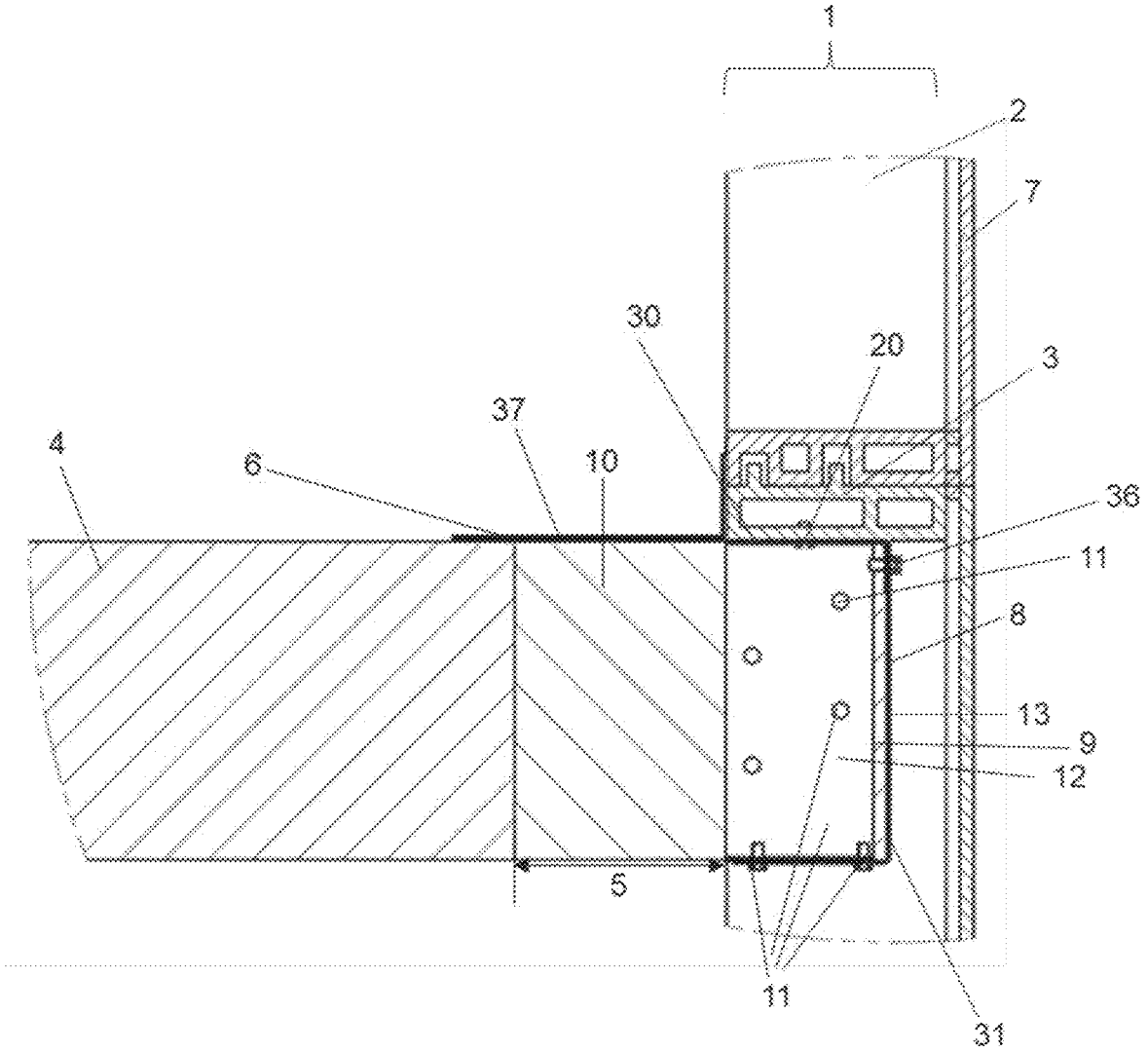
FIG. 4 shows the assembled unitized panel installed to improve fire stopping at the safing slot of an exterior dynamic curtain wall assembly.

FIG. 4 shows the assembled unitized panel installed to improve fire stopping at the safing slot 5 of an exterior dynamic curtain wall assembly. A thermally resistant material 9 for insulating is positioned in U-shaped cavity 8. The thermally resistant material 9 preferably fills the cavity to a depth of 2⅞ inch with 4-pcf density mineral wool batt insulation with the fibers running parallel to the floor and is compressed 25% vertically in the U-shaped cavity 8. Another thermally resistant material 10 is installed in the safing slot and is preferably mineral wool, preferably having a min. 4-pcf density and a thickness of 4 inch. Not shown in FIG. 4 is that the thermally resistant flexible mineral wool material 10 is installed with fibers running parallel to the outer edge 6 of the floor 4. To improve fire stopping at the safing slot of an exterior dynamic curtain wall assembly, an outer fire retardant coating 37 is applied and positioned across the thermally resistant material 10 installed in the safing slot 5 and the adjacent portions of the vertical 2 and horizontal framing members 3 and the floor 4 located thereadjacent. The other remaining elements are the same as described for FIGS. 2 and 3.

It should be appreciated that these embodiments of the present invention will work with many different types of insulating materials used for the insulating materials employed in the U-shaped cavity and within the safing slot as well as different types of the non-combustible material used for the 5-sided box pan as long as the material has effective high temperature insulating characteristics. Each unitized panel manufacturer has its own architectural design, which requires minor adjustments to the construction process. These include but are not limited to the water-tight gaskets, anchor bracket attachment method, and mullion/transom design.

The tested assembly using the assembled unitized panel achieved and an F-Rating of 120 min as well as a movement rating of class IV.

It has been shown that the unitized panel installed within an exterior dynamic curtain wall assembly of the present invention, maintains sealing of the safing slots surrounding the floor of each level in a building.

In particular, it has been demonstrated that the unitized panel installed within an exterior dynamic glass curtain wall assembly of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining safing insulation between the floors of a residential or commercial building and the exterior curtain wall responsive to various conditions including fire exposure is guaranteed.

Further, it has been shown, that the unitized panel installed within an exterior dynamic glass curtain wall assembly of the present invention meets the requirements of a full-scale ASTM E 2307 as well as full-scale ASTM E 1399 tested system for floor assemblies where the vision glass extends to the finished floor level, addressing the code exception, avoiding letters and engineering judgments and securing and providing defined/tested architectural detail for this application, in particular providing a tested system for fire- and movement-safe architectural compartmentation.

In particular, the tested system according to the present invention provides for the employment of reduced curtain wall insulation to only 6 inch height, resulting in up to 40% curtain wall material savings to the closest 10 inch spandrel system. Further, no top horizontal transom cover is needed for maximum vision glass/architectural exposure top of slab. Another great advantage of the unitized panel installed within an exterior dynamic curtain wall assembly of the present invention is that mineral wool is not exposed and does not need to be superior water resistant from all directions, no fiber distribution can occur to the air and no mineral wool is visible for architectural looks. Further, no stiffeners, hat channel, weld pins or similar means are needed to install/fasten the insulation, rather it can be simply fitted by friction fit. Additionally, the mineral wool is installed with only 25% compression, whereas standard systems require 33% compression.

It has been shown that the unitized panel makes it easier for the installers to build up the curtain wall on the jobsite. A unitized curtain wall panel production allows the curtain wall manufacturers to install all required curtain wall components offsite and then ship the complete unitized panel onsite for an easy quick installation on to the building.

As such, the unitized panel installed within an exterior dynamic curtain wall assembly of the present invention provides a system for effectively maintaining a complete seal in a safing slot when utilizing a glass curtain wall construction, vision glass extends to the finished floor level below.

The curtain wall design of the present invention clearly simplifies fire protection installation and can be used to add additional insulation for other mechanical purposes, such as for example STC, R-value, and the like.

Finally, it has been shown that the unitized panel installed within an exterior dynamic curtain wall assembly according to the present invention is also for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A process for assembling a unitized panel for an exterior dynamic curtain wall, the process comprising:

installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to an upper horizontal framing member of a frame, configured for the unitized panel, and upper locations of vertical framing members of the frame and the first leg of the second L-shaped member are connected to the second leg of the first L-shaped member, thereby forming a substantially U-shaped cavity;

fastening the substantially U-shaped cavity to an inner facing side of the vertical framing member, thereby forming a 5-sided box pan; and installing glass and optionally one or more appropriate sealing layers to the unitized panel, thereby completing the unitized panel.

2. The process according to claim 1, wherein the first and the second L-shaped members each comprise a metal material.

3. The process according to claim 2, wherein the first and the second L-shaped members each comprise 18 gauge galvanized steel.

4. The process according to claim 1, wherein the substantially U-shaped cavity is fastened by at least one element selected from the group consisting of pins, expansion anchors, screws, screw anchors, bolts and adhesion anchors.

5. The process according to claim 1, wherein a support or attachment is used in the fastening of the substantially U-shaped cavity to an inner facing side of the vertical framing member, and wherein the support or attachment has a substantially L-shaped profile and is positioned so that a gap between the U-shaped cavity and the vertical framing member is closed due to an architectural structure of the unitized panel assembled within the exterior dynamic curtain wall.

6. The process according to claim 1, further comprising installing a thermally resistant material into the substantially U-shaped cavity, wherein the thermally resistant material is a thermally resistant flexible mineral wool material to facilitate placement thereof into the substantially U-shaped cavity.

7. The process according to claim 1, wherein the 5-sided box pan has a depth of at least 3 inches and a height of at least 6 inches.

8. The process according to claim 1, wherein a back of the U-shaped cavity is positioned spatially disposed from an interior wall surface of the exterior dynamic curtain wall.

9. The process according to claim 8, wherein the exterior dynamic curtain wall comprises a vision glass infill, and wherein the back of the U-shaped cavity is positioned spatially disposed from an inner surface of the vision glass infill.

10. A unitized panel assembled according to the process of claim 1.

11. A process for installing the unitized panel according to claim 8 to improve fire stopping at a safing slot of an exterior dynamic curtain wall assembly, comprising:

hanging the unitized panel to a building structure;

installing a thermally resistant material in the safing slot; and applying an outer fire retardant coating positioned across the thermally resistant material installed in the safing slot and the adjacent portions of the vertical and horizontal framing members and a floor located there adjacent.

12. The process according to claim 11, wherein the outer fire retardant coating has a wet film thickness of at least ⅛ inch or 2 mm.

13. The process according to claim 11, wherein the outer fire retardant coating is a water-based or silicone-based outer fire retardant coating.

14. The process according to claim 11, wherein the outer fire retardant coating is in the form of at least one selected from the group consisting of an emulsion, spray, coating, foam, paint, and mastic.

15. A building construction, comprising:

a curtain wall construction, defined by an interior wall surface, including one or more framing members, and at least one floor, spatially disposed from the interior wall surface of the curtain wall construction, thereby defining a safing slot, extending between the interior wall surface of the curtain wall construction and an outer edge of the floor, wherein the curtain wall construction comprises the unitized panel according to claim 10.

16. A method for acoustically insulating and sealing of a safing slot of a curtain wall structure, the method comprising:

installing the unitized panel according to claim 10 to the curtain wall structure.

* * * * *